US007178682B2

(12) United States Patent
Willim

(10) Patent No.: US 7,178,682 B2
(45) Date of Patent: Feb. 20, 2007

(54) TRAVELING CRANE

(75) Inventor: Hans-Dieter Willim, Ulm (DE)

(73) Assignee: Liebherr-Werk Ehingen GmbH, Ehingen/Donau (DE)

( * ) Notice: Subject to any disclaimer, the term of this patent is extended or adjusted under 35 U.S.C. 154(b) by 0 days.

(21) Appl. No.: 10/821,080

(22) Filed: Apr. 8, 2004

(65) Prior Publication Data

US 2004/0256344 A1 Dec. 23, 2004

(30) Foreign Application Priority Data

Apr. 8, 2003 (DE) ..... 203 05 683

(51) Int. Cl.
*B66C 23/80* (2006.01)

(52) U.S. Cl. ..... 212/302; 180/9.46

(58) Field of Classification Search ..... 212/301–305; 180/9.44, 9.46
See application file for complete search history.

(56) References Cited

U.S. PATENT DOCUMENTS 3,312,291 A * 4/1967 Haug ..... 173/28
3,545,627 A * 12/1970 Letourneau ..... 212/303
3,608,756 A 9/1971 Guinot
4,049,070 A * 9/1977 Soyland ..... 180/8.5
4,124,226 A * 11/1978 Phillips ..... 280/765.1
4,336,889 A * 6/1982 McGrew ..... 212/178
4,371,046 A * 2/1983 Read ..... 175/57
4,387,814 A 6/1983 Beduhn et al.
4,515,520 A * 5/1985 Parquet et al. ..... 414/718
4,797,060 A * 1/1989 Kishi et al. ..... 414/687

FOREIGN PATENT DOCUMENTS

| | | |
|---|---|---|
| DD | 223992 | 6/1985 |
| DE | 1944214 | 5/1970 |
| GB | 2135273 | 8/1984 |

* cited by examiner

*Primary Examiner*—Thomas J. Brahan
(74) *Attorney, Agent, or Firm*—Dilworth & Barrese LLP

(57) ABSTRACT

The invention pertains to a traveling crane consisting of a superstructure that can be turned about an upright axis and carries a crane jib with hoisting means, a truck with a tracklaying gear that carries the superstructure and a supporting device with several outriggers that can be raised and lowered, wherein the superstructure as well as the truck can be turned relative to the supporting device about an upright axis.

20 Claims, 11 Drawing Sheets

Figure 3:
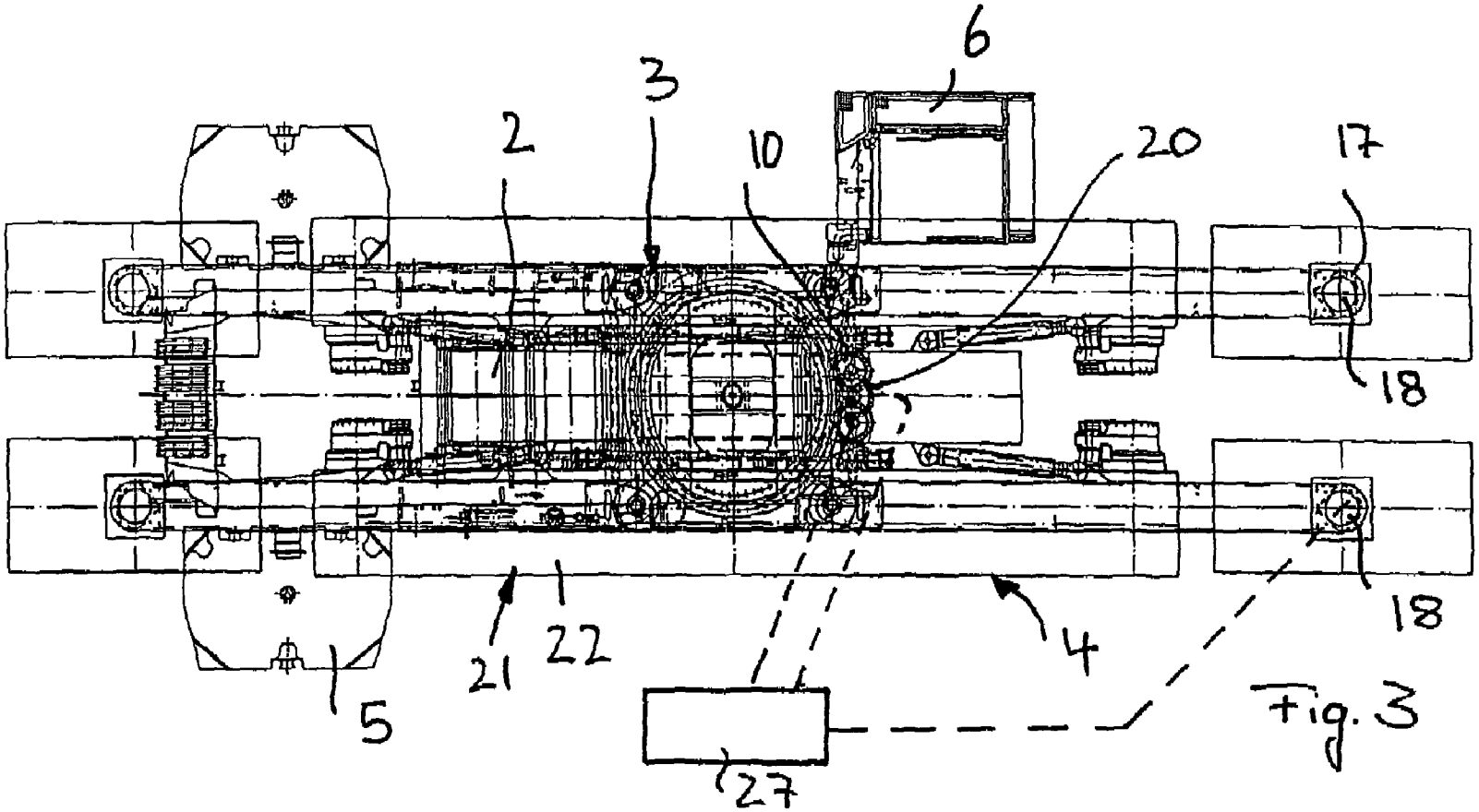

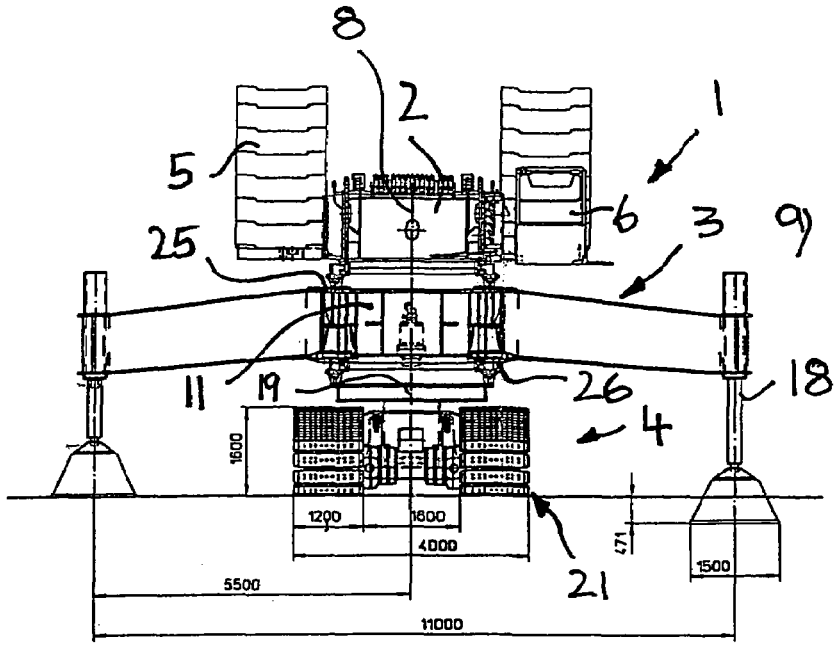
Fig. 1
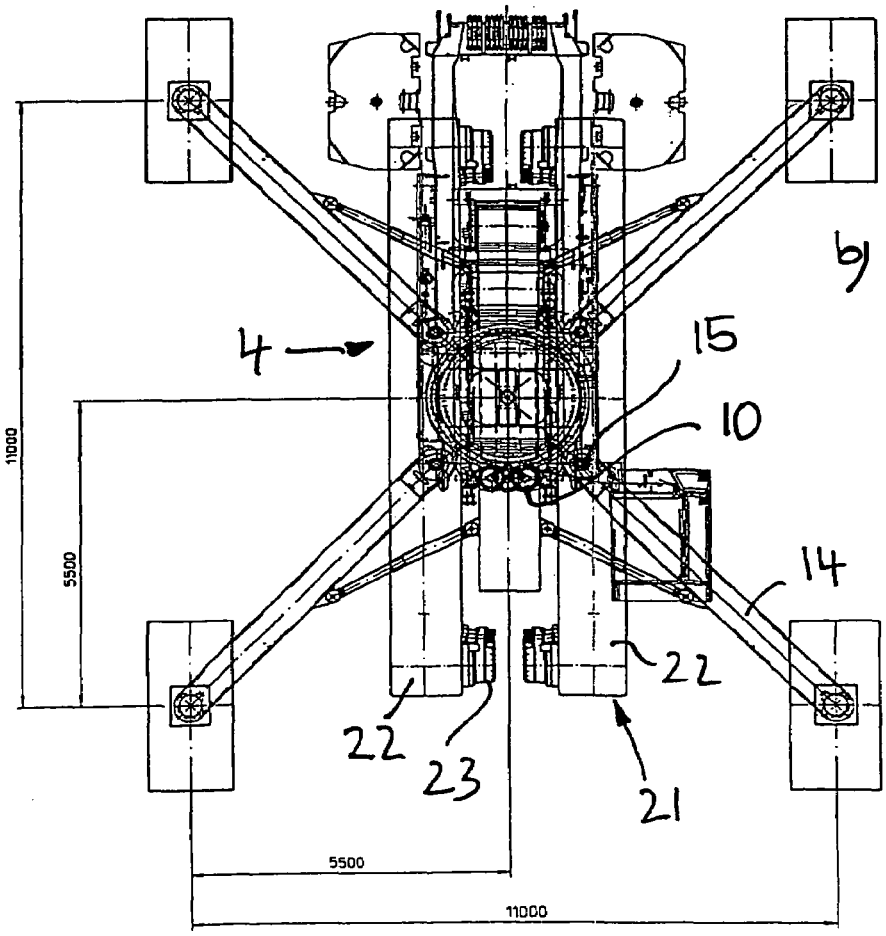

a)
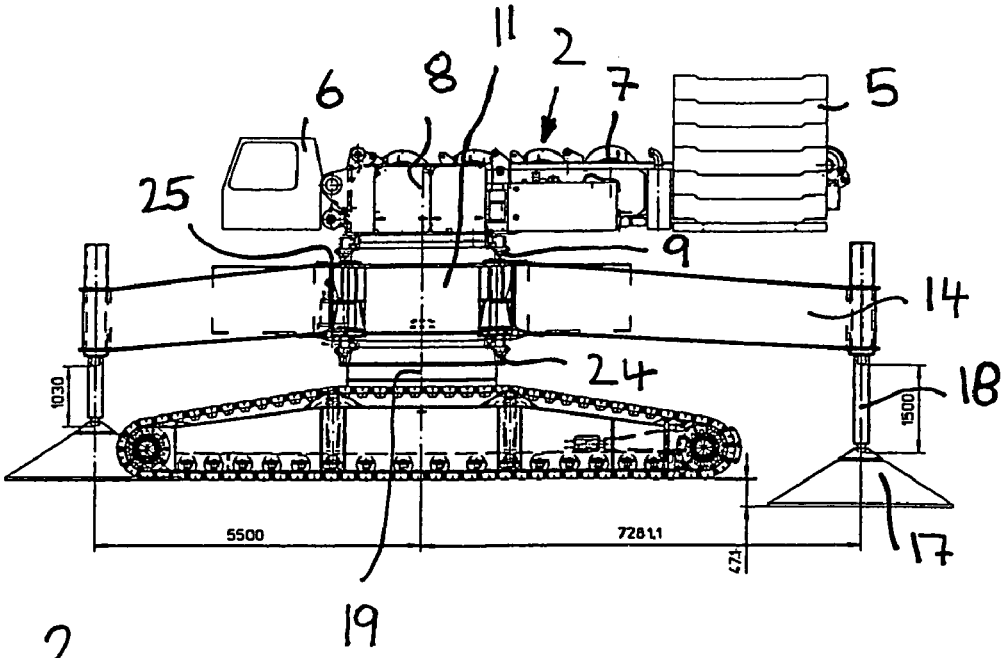
Fig. 2
b)
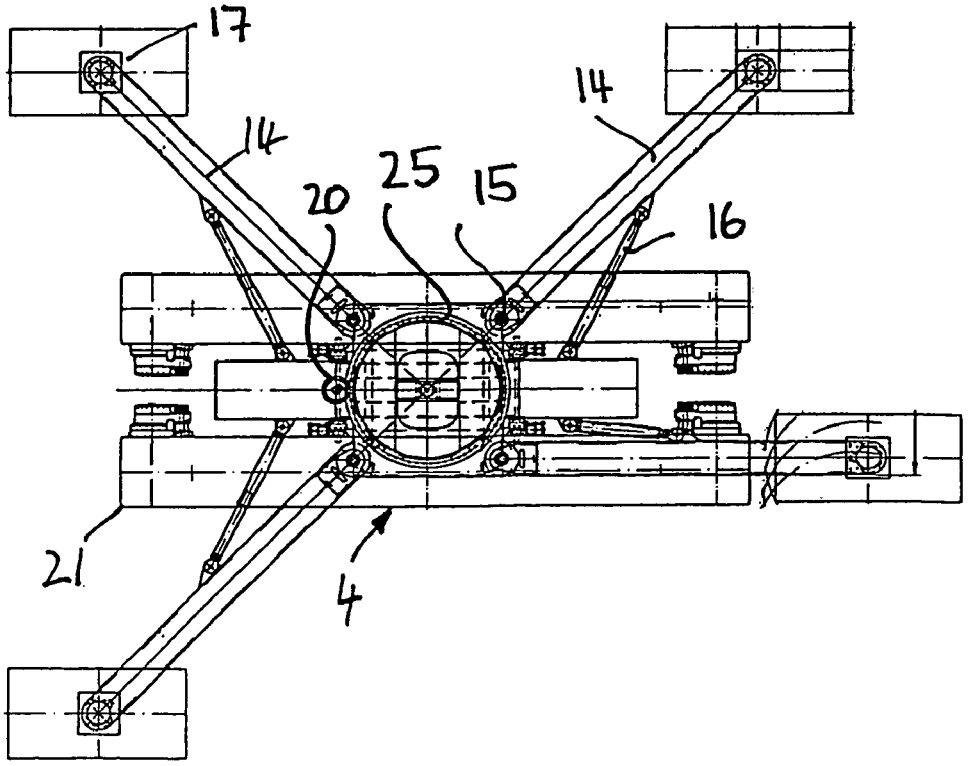

TRAVELING CRANE

BACKGROUND OF THE INVENTION

The present invention pertains to a traveling crane consisting of a superstructure that can be turned about an upright axis and carries a crane jib with hoisting means, a truck with a tracklaying gear that carries the superstructure and a supporting device with several outriggers that can be raised and lowered.

In certain applications, the respective crane used needs to be mobile and also have a very small track gauge because the roadway to be traveled by the crane only has a limited width. It occasionally occurs that a maximum width of only four meters is available. If significant hoisting heights need to be reached and it is required to lift comparatively heavy loads, a correspondingly large crane needs to be utilized which is difficult to maneuver with a tracklaying gear that has such a narrow track gauge. It is usually not possible to drive a crane equipped with rubber tires while its equipment is in the upright position, namely because the soft rubber tires do not ensure a sufficient lateral stability. However, tracklaying gears with very small track gauges make it very difficult to steer the crane because the distance between the tracks is so small that the crane can no longer be steered by decelerating one track or by driving both tracks in opposite directions.

SUMMARY OF THE INVENTION

The present invention is based on the objective of developing an improved traveling crane of the initially described type which does not have the disadvantages of the state of the art and represents an advantageous additional development thereof. The invention aims, in particular, to develop a crane that has a tracklaying gear with a very narrow track gauge, but can still be steered while traveling.

According to the invention, this objective is attained with a traveling crane with the characteristics of a superstructure that can be turned about an upright axis and carries a crane jib with hoisting means, a truck with a tracklaying gear that carries the superstructure and a supporting device with several outriggers that can be raised and lowered, wherein the superstructure as well as the truck can be turned relative to the supporting device about an upright axis. Preferred embodiments of the invention form the objects of the invention.

In the crane according to the invention, the superstructure as well as the truck can be turned relative to the supporting device about an upright axis. In other words, the entire supporting device including all outriggers can be turned relative to the superstructure and the truck about an essentially vertical axis. In this case, the superstructure and the truck can also be turned relative to the supporting device in the operating position of the supporting device, i.e., while the outriggers are lowered onto the ground. The tracklaying gear can be lifted off the ground and turned while the crane is supported on the ground by the supporting device. The crane is exclusively supported on the ground by the supporting device in this case. Consequently, the supporting device can be utilized for steering the crane. The crane is initially supported on the ground by means of the supporting device such that the tracklaying gear can be lifted off the ground. The tracklaying gear is then turned in the new driving direction and lowered back onto the ground such that the crane is able to travel in the desired new driving direction.

According to an additional development of the invention, the superstructure and the truck can be independently turned relative to the supporting device. When turning the truck with the tracklaying gear, the superstructure does not necessarily have to turn simultaneously with the truck and vice versa. A first revolving connection is provided between the superstructure and the supporting device. A second revolving connection is provided between the supporting device and the truck such that the three respective subassemblies, namely the superstructure, the supporting device and the truck, can be turned individually. It is preferred to assign a separate rotary drive to each revolving connection, wherein the respective rotary drives can be actuated independently of one another in order to achieve the individual turning motion. A first rotary drive may be provided for turning the superstructure, and a second rotary drive may be provided for turning the truck relative to the supporting device. If applicable, it would also be conceivable to provide only one common rotary drive on the supporting device instead of two separate rotary drives. This common rotary drive can be selectively coupled to the superstructure or the truck or both such that the desired subassembly can be turned relative to the supporting device depending on the coupling state.

In order to turn the truck while the tracklaying gear is lifted off the ground, the supporting device may be designed such that it is able to raise the entire crane including the truck and the superstructure. Alternatively, it would also be possible for the truck to contain a tracklaying gear that can be raised. In this case, it would merely be required to place the outriggers of the supporting device onto the ground without raising the superstructure and the entire truck. In any case, a steering maneuver of the crane is realized by lifting the tracklaying gear off the ground and turning the truck relative to the supporting device that stands on the ground and carries the entire weight of the crane.

In order to achieve an unrestricted steering motion, all contact points between the supporting device and the ground preferably lie outside the turning radius of the truck and the tracklaying gear mounted thereon. This measure makes it possible to turn the truck in the desired new driving direction without encountering obstacles. The supporting device preferably can be freely turned by 360° in an unobstructed fashion.

According to an additional development of the invention, a control device 27 is provided in order to steer the crane in the desired new driving direction, wherein this control device 27 defines a certain sequence of turning motions of the superstructure on one hand and of the truck on the other hand. The control device 27 controls the lowering of the supporting device and its turning motion relative to the superstructure and the truck, respectively. The control device 27 is designed, in particular, such that the supporting device is initially lowered onto the ground and the tracklaying gear is subsequently lifted off the ground. The truck is then turned in the desired new driving-direction while the tracklaying gear is lifted off the ground. The control device 27 then causes the tracklaying gear to be lowered onto the ground and the supporting device to be lifted off the ground. In order to improve the stability during steering maneuvers, the control device 27 does not turn the superstructure and the truck at the same time. In other words, the superstructure and the truck are not simultaneously turned in the new driving direction. The control device 27 is designed, in particular, such that the supporting device and the tracklaying gear are in contact with the ground while the superstructure is turned in the new driving direction, wherein the truck and the supporting device preferably point in different driving directions, i.e., the truck either is already turned in the new driving direction while the supporting device still points in the old driving direction or the supporting device is already turned in the new driving direction while the truck still points in the old driving direction. This ensures a particularly stable ground contact of the crane. In this case, it is possible to initially turn the supporting device with its outriggers or, after having been raised accordingly, the tracklaying gear in the new driving direction before the superstructure is turned. In both instances, the supporting device and the tracklaying gear are brought in contact with the ground before the superstructure is turned.

The track gauge of the tracklaying gear can be varied and adapted to the respectively available width of the roadway. The truck with its tracklaying gear preferably has a total width of no more than four meters. The outside length of the tracks of the tracklaying gear may amount to more than twice the total width of the truck including the tracklaying gear. Referred to the track gauge that corresponds to the distance between the longitudinal center lines of the outer tracks, the tracklaying gear used may have a track gauge to track length ratio of approximately one-third or less.

It is advantageous that the width of the supporting device can be adjusted transverse to the driving direction. The ground contact surface can be increased by providing the supporting device with outriggers that can be extended transverse to the driving direction and retracted for the driving mode. The supporting device preferably has outriggers that can be pivoted about an upright axis and the projecting ends of which carry legs that can be raised and lowered. The outriggers can be pivoted into an operating position and retracted into a driving position, wherein the outriggers preferably do not protrude over the total width of the truck in the driving position.

According to an additional development of the invention, the crane has a modular design with respect to the subassemblies superstructure, supporting device and truck. The respective crane can be advantageously assembled in accordance with the building block principle. A separable coupling may be provided, in particular, between the supporting device and the truck such that the supporting device with the superstructure arranged thereon can be placed onto different trucks. This would make it possible to place the crane onto a tracklaying gear with a narrower track gauge for special tasks and to utilize a conventional tracklaying gear with a normal track gauge for conventional tasks, in which a wide roadway is available.

The supporting device may contain a center part, on which several outriggers are mounted, as well as a superstructure bearing for rotatably supporting the superstructure and a truck bearing for rotatably supporting the truck. In order to achieve a modular design, the superstructure bearing preferably is realized complementary to the truck bearing, i.e., the superstructure bearing on the center part of the supporting device corresponds to the bearing that is provided on the truck and carries the center part and the superstructure, respectively. The truck bearing on the center part of the supporting device corresponds to the bearing provided on the superstructure. The complimentary design, of the superstructure bearing and the truck bearing on the central part of the supporting device makes it possible to directly place the superstructure onto the truck. If the supporting device is not needed, it can be removed and the superstructure and the truck can be directly connected to one another. It is advantageous to provide separable rapid-action couplings between the superstructure and the supporting device on one hand and between the supporting device and the truck on the other hand in order to shorten the conversion process.

BRIEF DESCRIPTION OF THR DRAWINGS

Figure 4:
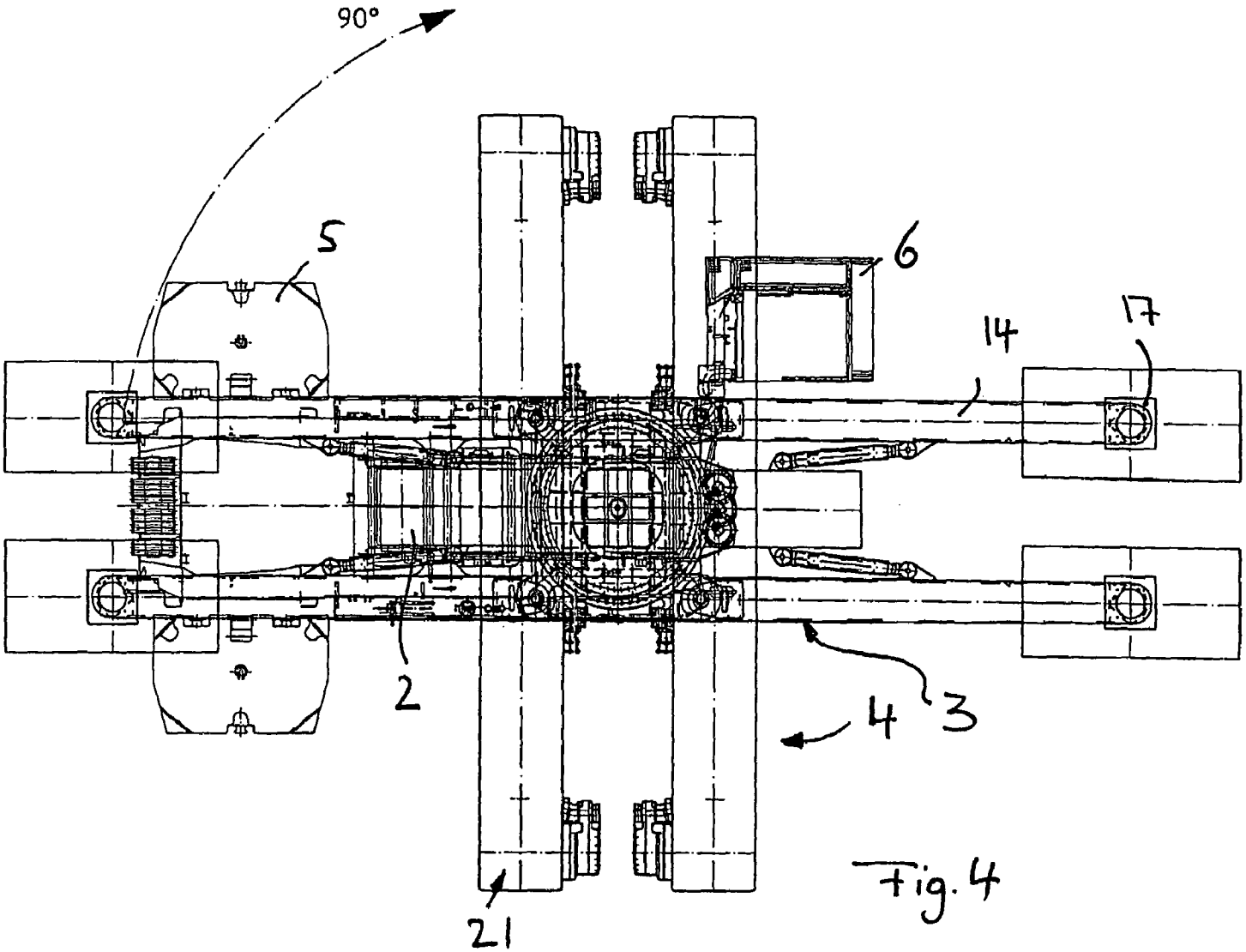
Figure 5:
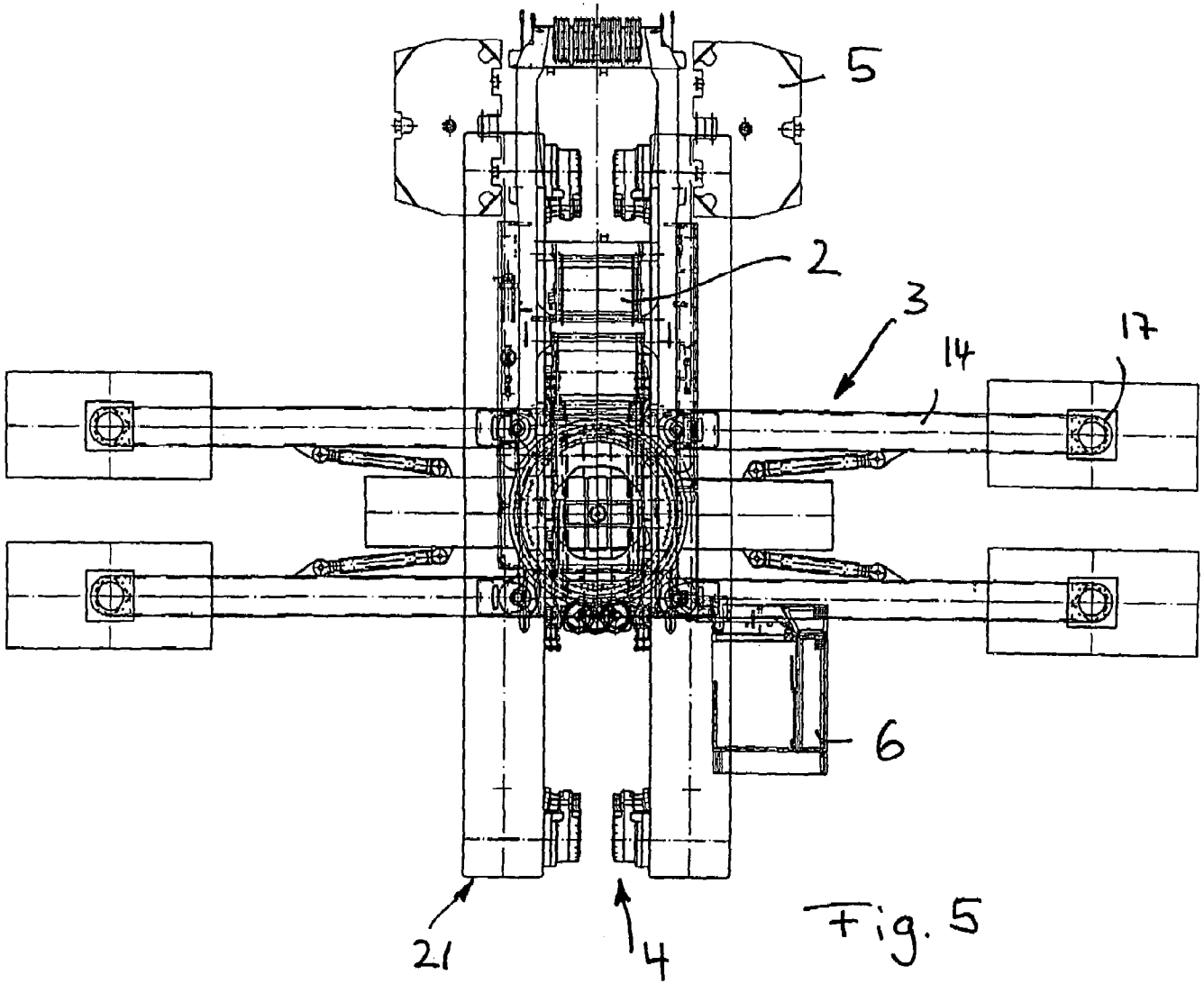
Figure 6:
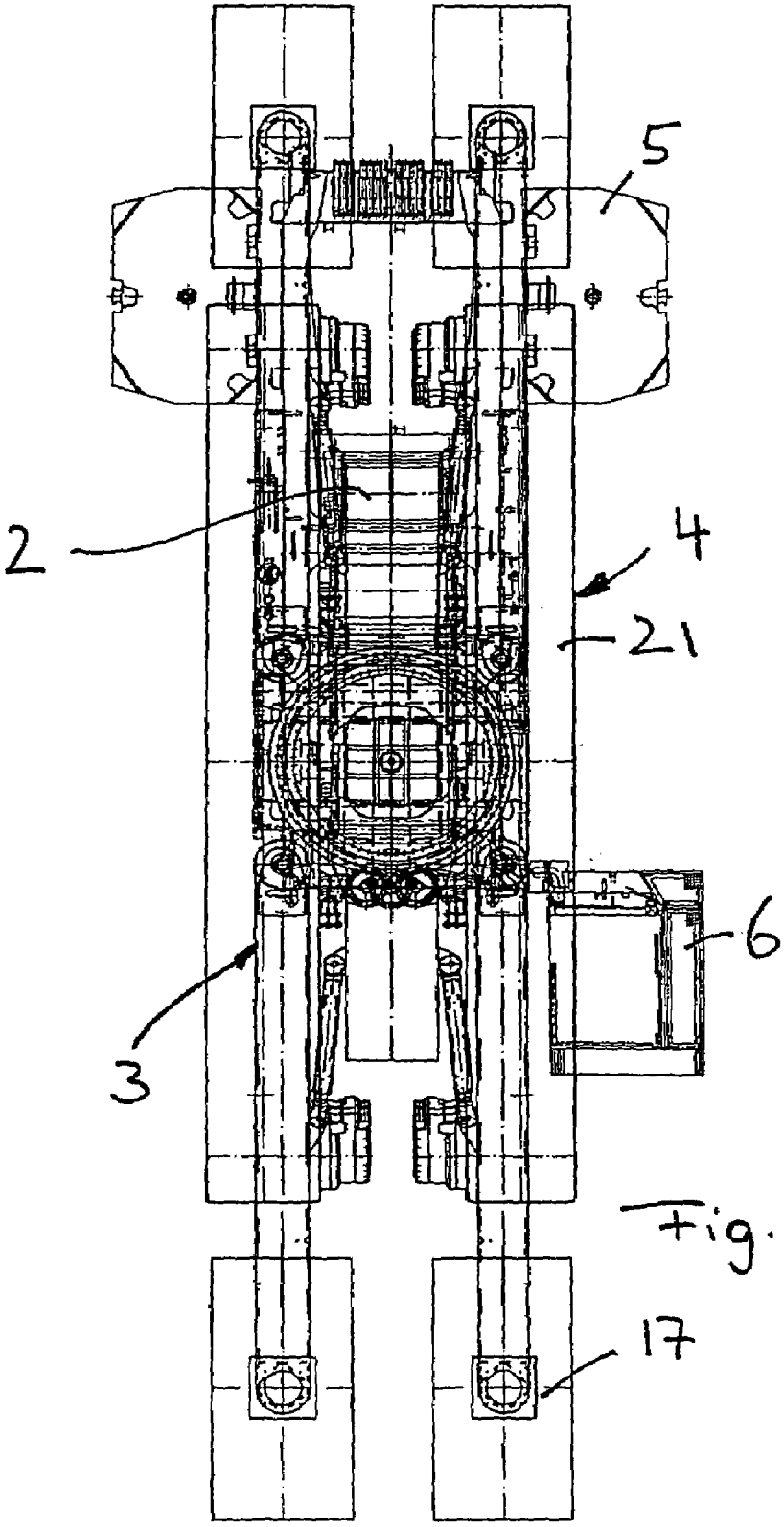
Figure 7:
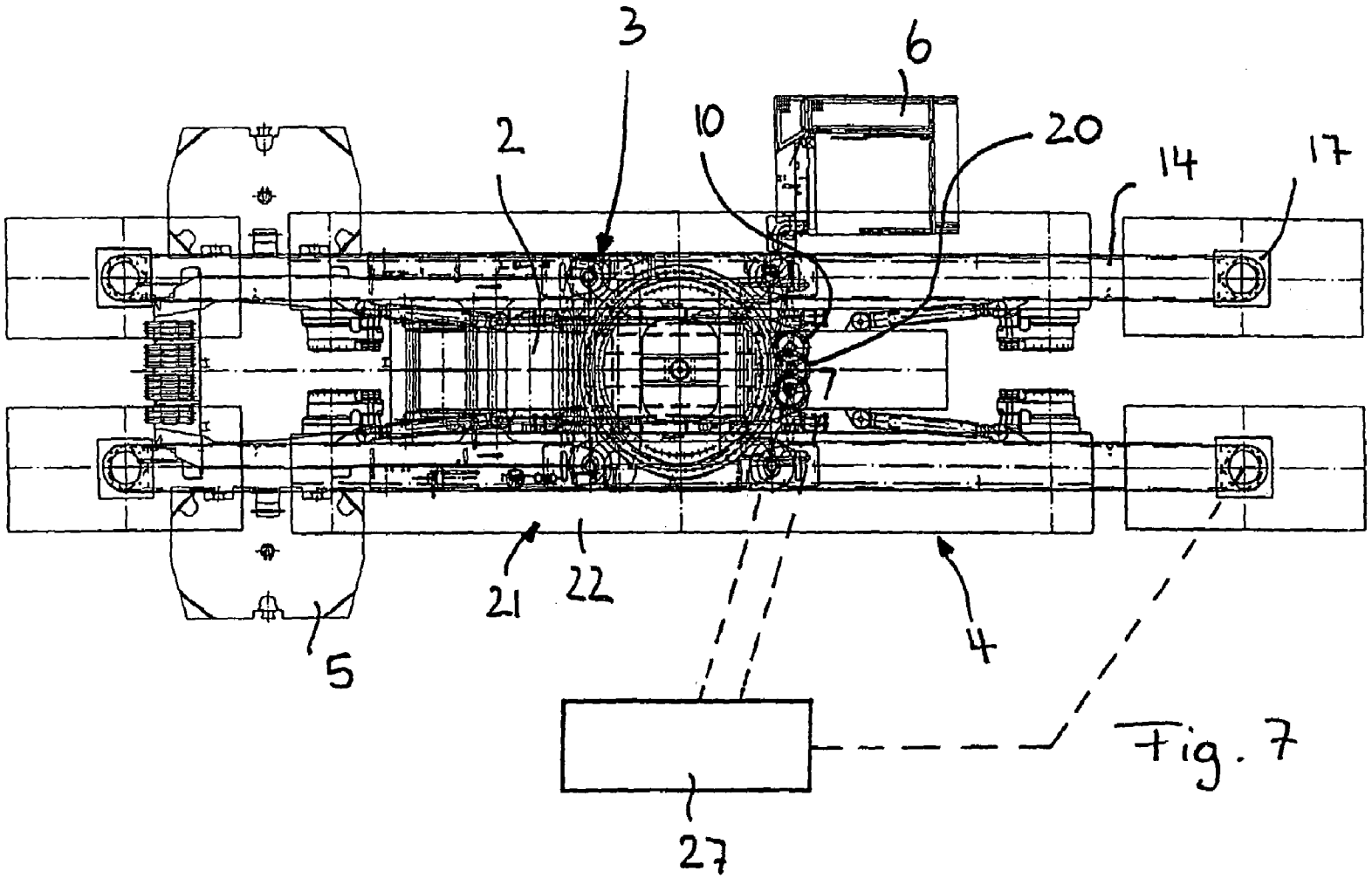
Figure 8:
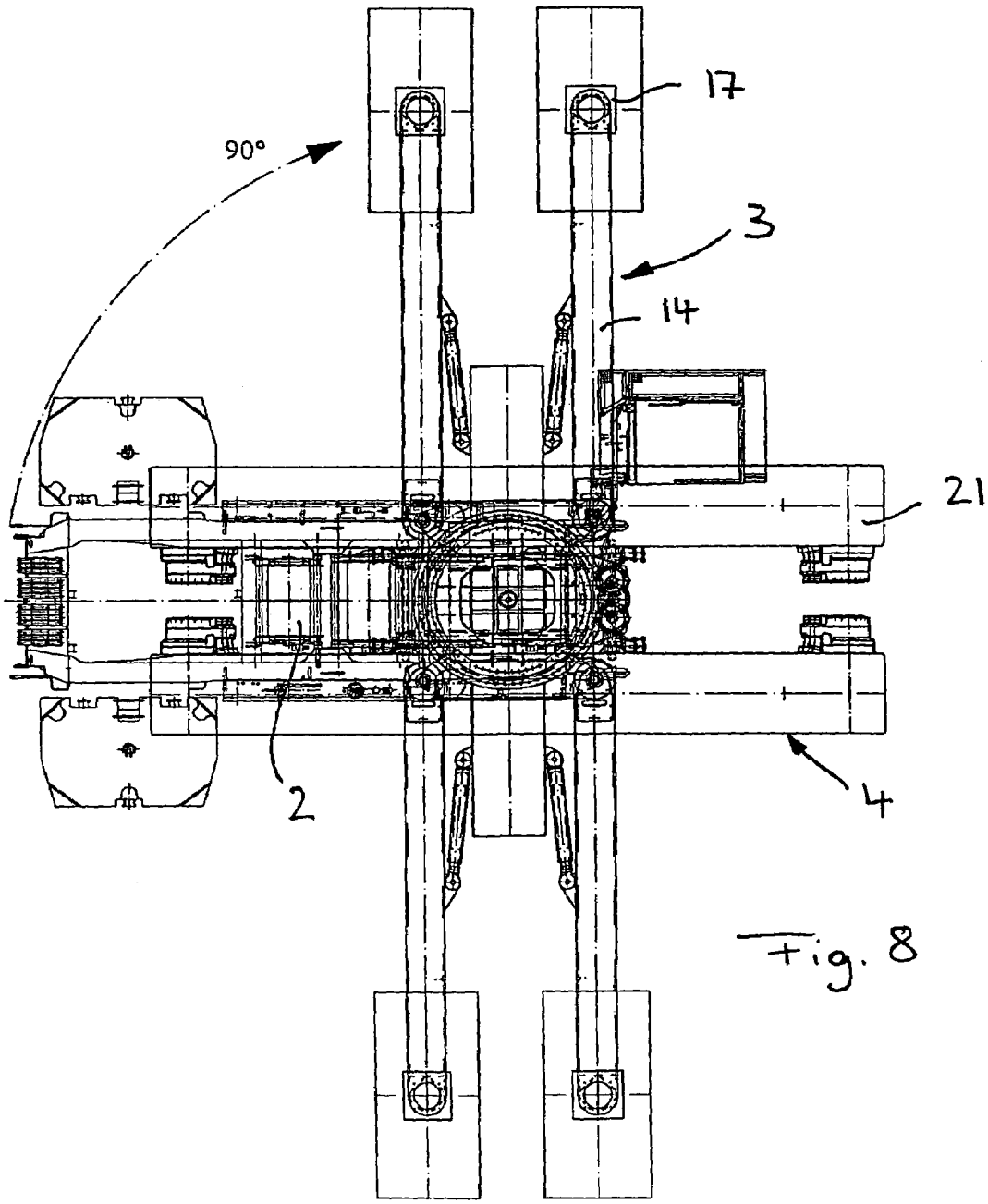
Figure 9:
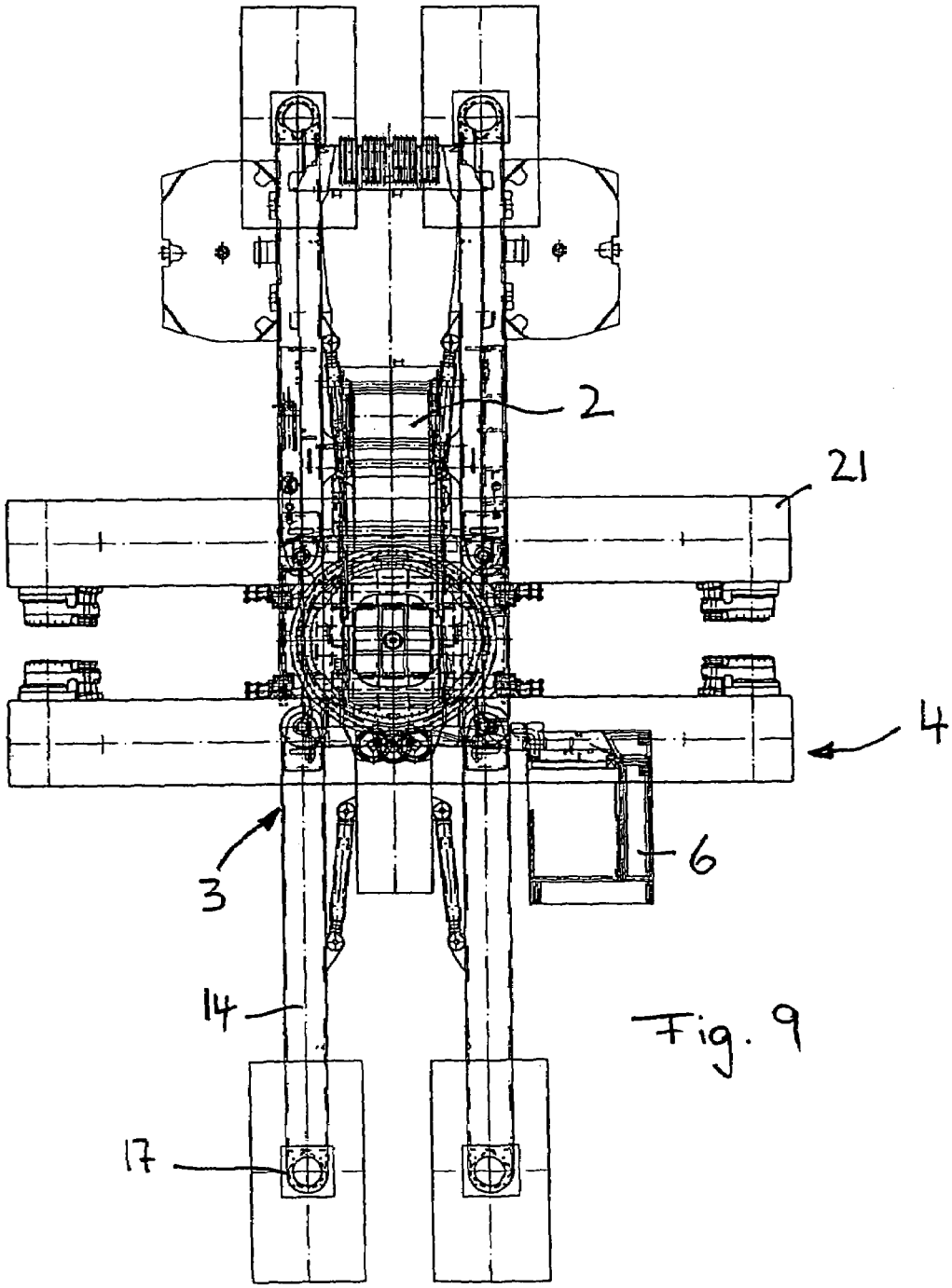
Figure 10:
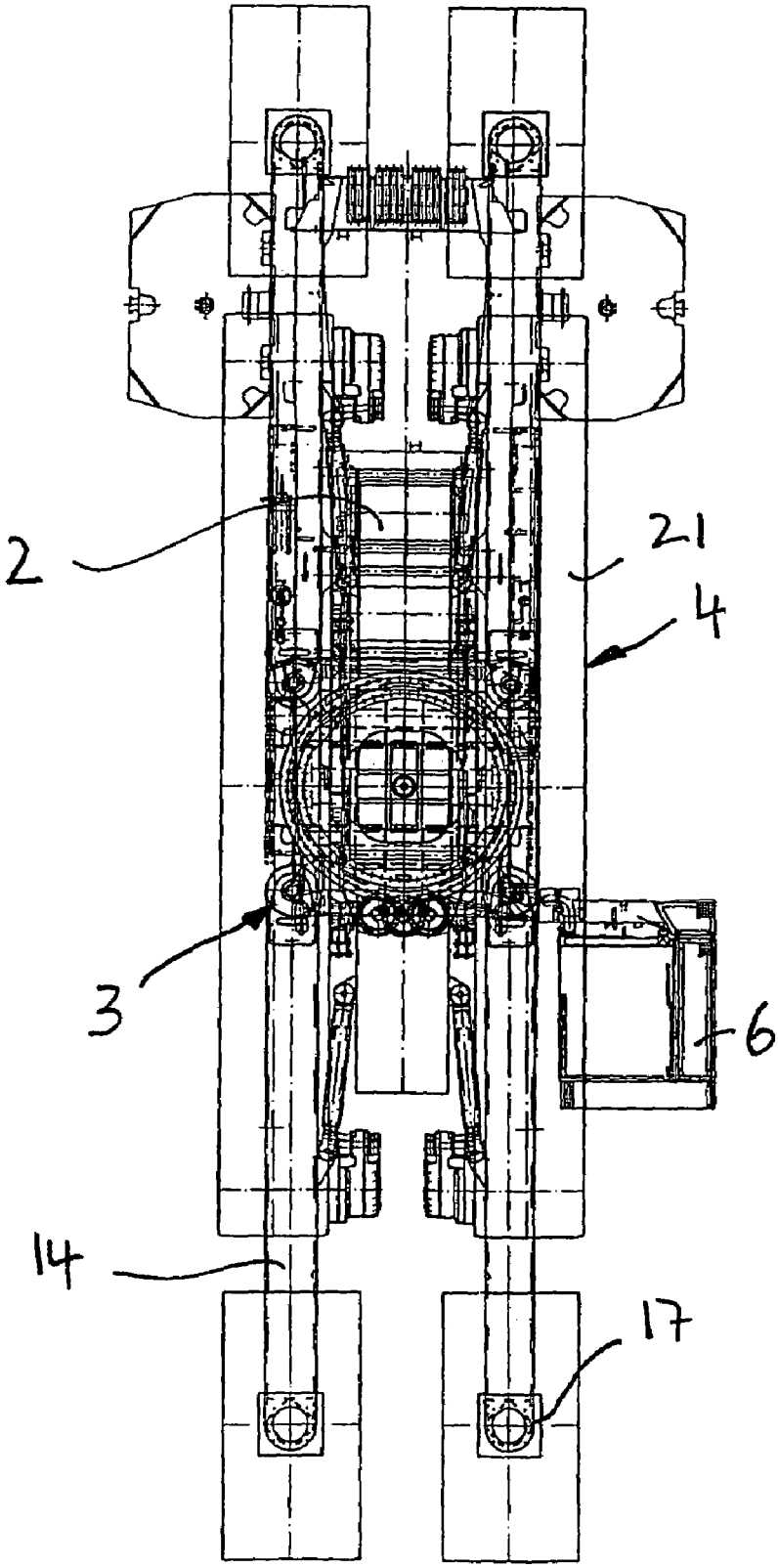
Figure 11:
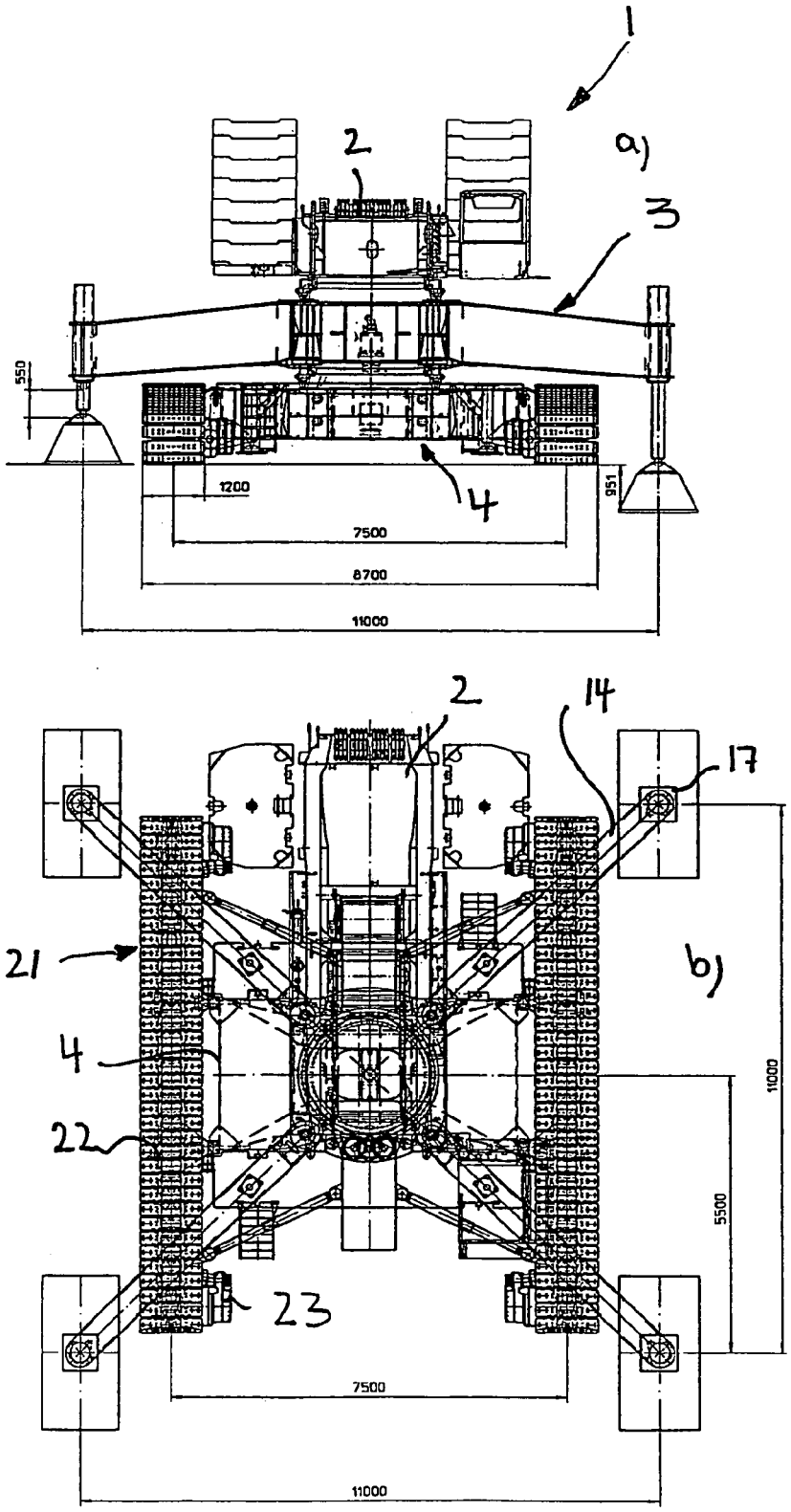

The invention is described in greater detail below with reference to one preferred embodiment and the corresponding figures. The figures show:

FIG. 1, a front view a) and a top view b) of one preferred embodiment of a traveling crane according to the invention, wherein the truck and the superstructure of the crane, as well as the supporting device, are turned in the driving direction, and wherein the supporting device is extended and lowered onto the ground;

FIG. 2, a side view a) and a top view of the crane shown in FIG. 1, wherein one outrigger of the supporting device is pivoted into its driving position and the superstructure is not illustrated in the top view b);

FIG. 3, a top view of the crane shown in the preceding figures, wherein the outriggers of the supporting device are pivoted into the driving position;

FIG. 4, a top view of the crane shown in the preceding figures, wherein the supporting device is lowered from its driving position and the truck with the raised tracklaying gear is turned by 90°;

FIG. 5, a top view of the crane shown in the preceding figures, wherein the superstructure is also turned by 90° in comparison with FIG. 4;

FIG. 6, a top view of the crane shown in the preceding figures, wherein the supporting device is also turned in the new driving direction in comparison with FIG. 5;

FIG. 7, a top view of a crane similar to that shown in FIG. 3, wherein the crane points in an old driving direction before being steered in the desired new driving direction;

FIG. 8, a top view of the crane shown in FIG. 7, wherein only the supporting device is initially turned in the desired new driving direction by 90°;

FIG. 9, a top view of the crane shown in the preceding figures, wherein the superstructure is also turned in the new driving direction in comparison with FIG. 8 while the truck still points in the old driving direction;

FIG. 10, a top view of the crane shown in the preceding figures, wherein the truck is also turned in the new driving direction in comparison with FIG. 9, and FIG. 11, a front view a) and a top view b) of a crane similar to that shown in FIG. 1, wherein a truck with a wider tracklaying gear is used instead of a truck with a narrow tracklaying gear.

DESCRIPTION OF THE PREFERRED EMBODIMENTS

The traveling crane 1 shown in FIGS. 1–3 comprises a superstructure 2, a supporting device 3 and a truck 4.

The superstructure 2 comprises a not-shown crane jib with hoisting means that may be realized in the form of a telescopic jib that is able to derrick about a horizontal axis. The superstructure 2 also comprises ballast means 5, a driver's cabin 6 and various drive assemblies 7, e.g., a hoisting mechanism with a corresponding drive or a derricking cylinder with a corresponding hydraulic drive for setting the crane jib upright.

The superstructure 2 is supported on the supporting device 3 such that it can be essentially turned about a vertical axis of rotation 8, wherein a separable rapid-action coupling 9 is provided between the superstructure 2 and the supporting device 3. The superstructure 2 can be turned relative to the supporting device 3 by means of a superstructure rotary drive 10.

According to FIGS. 1 and 2, the supporting device 3 comprises a central frame-like center part 11 that may have an annular structure. Four outriggers 12 are mounted on the center part 11, wherein said outriggers can be respectively pivoted between a driving position and an operating position about a vertical pivoting axis 15 by means of corresponding actuators 16. The outer ends of the outriggers 14 are provided with legs 17 that can be raised and lowered by means of suitable actuating drives, for example, in the form of hydraulic cylinders 18. In the retracted driving position, the outriggers 14 with the legs 17 mounted thereon do not protrude over the maximum width of the truck 4. In the outwardly pivoted operating position, i.e., in the supporting position, the legs 17 essentially define a square. The lateral distance between the legs 17 transverse to the driving direction is more than twice as large as the track gauge of the narrow tracklaying gear of the truck 4.

The center part 11 of the supporting device 3 is supported on the truck 4 such that it can be turned about a vertical axis of rotation 19 that is positioned coaxially referred to the axis of rotation 8. A truck rotary drive 20 makes it possible to turn the supporting device 3 relative to the truck 4 independently of the superstructure 2. Vice versa, the superstructure rotary drive 10 makes it possible to turn the supporting device 3 relative to the superstructure 2 independently of the truck 4.

The truck 4 contains a tracklaying gear 21 that comprises two continuous tracks 22 arranged on the right and on the left in the embodiment shown. The tracklaying gear 21 can be rigidly mounted on the truck 4. The tracks are driven by means of track drives 23. In the embodiment shown, the maximum width of the truck 4 defined by the tracks 22 does not exceed four meters, wherein the total length of the tracks that simultaneously define the total length of the truck lies at approximately ten meters. The overall width of the truck consequently amounts to less than 50% of the total length of the tracks.

A separable rapid-action coupling 24 is provided between the truck 4 and the supporting device 3 analogous to the coupling between the superstructure 2 and the supporting device 3, wherein this rapid-action coupling makes it possible to separate the supporting device 3 from the truck 4. The center part 11 of the supporting device 3 contains a superstructure bearing 25 for rotatably supporting the superstructure and a truck bearing 26 for rotatably supporting the truck 4, wherein the superstructure bearing 25 is realized complementary to the truck bearing 26. If the supporting device 3 is separated from the superstructure 2 and from the truck 4 by disengaging the rapid-action couplings 9 and 24 and removed, the superstructure 2 can be directly placed onto the truck 4. If a tracklaying gear with a narrow track is not required, the separable rapid-action couplings also make it possible to mount a different truck 4. In this case, the rapid-action coupling 24 is disengaged and the supporting device 3 with the superstructure 2 arranged thereon is raised by lowering the outriggers 12. The narrow tracklaying gear is then driven away and replaced with another tracklaying gear that is illustrated in FIG. 11. Once the outriggers 12 are retracted, the center part 11 with the truck bearing 26 is placed onto the new truck. According to FIG. 11, the tracklaying gear of this truck may have a track width to track length ratio of approximately ¾ to 1.

The steering of the crane with the narrow tracklaying gear according to FIGS. 1 and 2 is realized as described below:

In the position according to FIG. 3, in which the crane still points in the old driving direction, the legs 17 of the supporting device 3 are initially lowered such that the supporting device 3 lifts the entire crane including the truck 4 with the tracklaying gear 21 off the ground. In this raised position of the tracklaying gear 21, the truck 4 is turned in the desired new driving direction relative to the supporting device 3 by means of the truck rotary drive 20. In FIG. 4, the truck is turned by 90°. The legs 17 are then slightly raised such that the tracklaying gear 21 once again comes in contact with the ground. The outriggers 12 remain in contact with the ground during this process. The superstructure 2 is then turned in the new driving direction relative to the supporting device 3 by means of the superstructure rotary drive 10. This means that the superstructure 2 is once again arranged parallel to the truck 4 as shown in FIG. 5.

The legs 17 are then lifted off the ground in order to turn the supporting device 3 in the new driving direction as shown in FIG. 6.

FIGS. 7–10 show another option for steering the crane in a new driving direction:

Initially, only the supporting device 3 is turned from the old driving direction shown in FIG. 7 in the new desired driving direction while the superstructure 2 and the truck 4 remain in the old driving direction as shown in FIG. 8. Naturally, the supporting device 3 is turned while the legs 17 are raised. Although the supporting device is turned by 90° according to FIG. 8, it goes without saying that any other turning angles can also be realized.

After the supporting device 3 has been turned, its legs 17 are lowered, namely to such a degree that the crane 1 is supported on the ground with the tracklaying gear 21 and the legs 17. The superstructure 2 is then turned in the new driving direction until it is arranged parallel to the supporting device 3 as shown in FIG. 9.

Once the superstructure 2 points in the new driving direction, the legs 17 are additionally extended until the tracklaying gear 21 of the truck 4 is lifted off the ground. The truck 4 can now also be turned until it points in the new driving direction according to FIG. 10. The legs 17 are then raised again and lifted off the ground such that the crane is able to continue traveling in the new driving direction.

During the steering maneuvers shown in FIGS. 3–10, the supporting device 3 may remain in the inwardly pivoted position, i.e., the outriggers 14 do not have to be pivoted outward and may remain in their inwardly pivoted transport configuration. This provides the advantage that the respective legs 17 come in contact with the stable roadway, on which the tracklaying gear travels.

The invention claimed is:

1. A traveling crane(1), comprising:

a superstructure (2) structured and arranged to be rotated about an upright axis (8,19) and carrying a crane jib with hoisting means, a truck (4) having tracklaying gear (21) that carries the superstructure (2) for translational movement, and a supporting device (3) positioned along said upright axis (8, 19) between said superstructure (2) and truck (4) and having several outriggers (14, 17) arranged to be raised and lowered, the superstructure (2) and truck (4) being individually rotatable relative to the supporting device (3) about said upright axis (8, 19) and the supporting device (3) arranged to raise the truck (4) together with the superstructure (2) such that the truck (4) is rotated about said upright axis (8, 19) to a new driving direction while said tracklaying gear (21) is lifted off the ground.

2. The crane according to claim 1, wherein a first revolving connection (9) is provided between the superstructure (2) and the supporting device (3) and a second revolving connection (24) is provided between the supporting device (3) and the truck (4) such that the superstructure (2) and the supporting device (3) can be turned relative to the truck (4) independently of one another, and separate drives (10, 20) that can be actuated independently of one another are assigned to each revolving connection (9, 24).

3. The crane according to claim 2, wherein the supporting device (3) is able to raise the truck (4) together with the superstructure (2) such that the truck can be turned while its tracklaying gear (21) is lifted off the ground.

4. The crane according to claim 2, wherein the supporting device (3) contacts the ground in points that lie outside the turning radius of the truck (4).

5. The crane according to claim 2, wherein a control device (27) for defining a sequence of turning motions of the superstructure (2) and the truck (4) is provided in order to steer the crane in a new driving direction, and wherein said control device initially lowers the supporting device (3) and lifts the tracklaying gear (21) of the truck (4) off the ground, then turns the truck (4) in the desired new driving direction while its tracklaying gear (21) is lifted off the ground and ultimately raises the supporting device (3) such that the tracklaying gear (21) once again comes in contact with the ground.

6. The crane according to claim 1, wherein the first revolving connection (9) and/or the second revolving connection (24) is/are realized in the form of a separable rapid-action coupling.

7. The crane according to claim 6, wherein the supporting device (3) is able to raise the truck (4) together with the superstructure (2) such that the truck can be turned while its tracklaying gear (21) is lifted off the ground.

8. The crane according to claim 6, wherein the supporting device (3) contacts the ground in points that lie outside the turning radius of the truck (4).

9. The crane according to claim 1, wherein the supporting device (3) contacts the ground in points that lie outside the turning radius of the truck (4).

10. The crane according to claim 1, wherein a control device (27) for defining a sequence of turning motions of the superstructure (2) and truck (4) is provided in order to steer the crane in a new driving direction, and said control device initially lowers the supporting device (3) and lifts the tracklaying gear (21) of the truck (4) off the ground, then turns the truck (4) in the desired new driving direction while its tracklaying gear (21) is lifted off the ground and ultimately raises the supporting device (3) such that the tracklaying gear (21) once again comes in contact with the ground.

11. The crane according to claim 10, wherein the control device (27) is realized in such a way that the superstructure (2) and the truck (4) are not turned in the new driving direction at the same time, and the superstructure (2) is turned in the new driving direction while the supporting device (3) as well as the tracklaying gear (21) of the truck (4) are in contact with the ground and either the truck (4) or the supporting device (3) is already turned in the new driving direction.

12. The crane according to claim 1, wherein the truck (4) with its tracklaying gear (21) has a total width that amounts to less than 50% of the outside length of the tracks (22) of the tracklaying gear(21).

13. The crane according to claim 1, wherein the supporting device (3) comprises a center part (11) as well as a superstructure bearing (25) for rotatably supporting the superstructure (2) and a truck bearing (26) for rotatably supporting the truck (4).

14. The crane according to claim 13, wherein the superstructure bearing (25) is realized complementary to the truck bearing (26), and a separable coupling is provided between the superstructure (2) and the center part (11) on one hand and/or between the center part (11) and the truck (4) on the other hand.

15. The crane according to claim 13, wherein the center part (11) of the supporting device (3) is structured and arranged to be placed onto different trucks (4) having different configuration or width.

16. The crane according to claim 14, wherein separable rapid-action couplings (9, 24) are provided between the superstructure (2) and the supporting device (3) on one hand and between the supporting device (3) and the truck (4) on the other hand.

17. The crane according to claim 14, wherein the center part (11) of the supporting device (3)is configured and dimensioned to be placed onto differently configured trucks (4) with different track widths.

18. The crane according to claim 1, wherein the outriggers (14) can be extended transverse to the driving direction in order to widen the ground contact surface, and are pivotally movable outward into an operating position and inward into a driving position about an upright axis.

19. The crane according to claim 1, wherein the supporting device (3) contacts the ground in points that lie outside the turning radius of the truck (4).

20. The crane according to claim 1, wherein said tracklaying gear (21) is rotatably positioned between said outriggers (14,17) in extended and lowered positioned.

* * * * *